US005344078A

United States Patent [19]

Fritz et al.

[11] Patent Number: 5,344,078

[45] Date of Patent: Sep. 6, 1994

[54] NOZZLE ASSEMBLY FOR HVLP SPRAY GUN

[75] Inventors: Alan H. Fritz, Toledo; Roger T. Cedoz; Mark D. Miller, both of Curtice, all of Ohio

[73] Assignee: Ransburg Corporation, Indianapolis, Ind.

[21] Appl. No.: 52,072

[22] Filed: Apr. 22, 1993

[51] Int. Cl.[5] ..... B05B 1/28

[52] U.S. Cl. ..... 239/296; 239/290

[58] Field of Search ..... 239/525, 526, 290, 291, 239/296, 297

[56] References Cited

U.S. PATENT DOCUMENTS

| | | | |
|---|---|---|---|
| 2,239,987 | 4/1941 | Bramsen et al. | 239/290 |
| 2,743,963 | 5/1956 | Peeps | 239/290 |
| 4,948,053 | 8/1990 | Hufgard | 239/296 |
| 4,993,642 | 2/1991 | Hufgard | 239/300 |
| 5,078,323 | 1/1992 | Frank | 239/296 |
| 5,102,051 | 4/1992 | Smith et al. | 239/297 |
| 5,152,460 | 10/1992 | Barty | 239/290 |
| 5,165,604 | 11/1992 | Copp, Jr. | 239/290 |
| 5,165,605 | 11/1992 | Morita et al. | 239/296 |
| 5,169,070 | 12/1992 | Mattson | 239/290 |
| 5,170,941 | 12/1992 | Morita et al. | 239/416.4 |
| 5,209,405 | 5/1993 | Robinson et al. | 239/296 |

FOREIGN PATENT DOCUMENTS

| | | | |
|---|---|---|---|
| 718437 | 1/1932 | France | 239/296 |

*Primary Examiner*—Andres Kashnikow
*Assistant Examiner*—Christopher G. Trainor
*Attorney, Agent, or Firm*—MacMillan, Sobanski & Todd

[57] ABSTRACT

An improved nozzle assembly for an HVLP paint spray gun. The nozzle assembly includes at least an air cap and a fluid tip, and preferably also includes a baffle for uniformly distributing air flow through the nozzle assembly. The fluid tip has a conical front end which terminates at a fluid discharge orifice adjacent a vertex. The fluid tip is positioned to extend to and to be in axial alignment with an opening in the air cap. The fluid discharge orifice is located at substantially the front face of the opening. The fluid tip and the air cap form an annular air discharge opening. The conical front end of the fluid tip has a vertex angle of from 60° to 90°, and preferably about 60°. The air cap has a thin wall surface surrounding the opening and has an annular interior surface surrounding the opening in the shape of a frustum of a right circular cone having a vertex angle of from 100° to 150° and preferably of from about 124° to about 128°. The design of the air cap interior and of the fluid tip maximize the energy in the low velocity air prior to interaction with fluid discharged from the nozzle to optimize atomization efficiency.

14 Claims, 3 Drawing Sheets

NOZZLE ASSEMBLY FOR HVLP SPRAY GUN

TECHNICAL FIELD

The invention relates to spray guns for atomizing liquid and more particularly to an improved nozzle assembly for a high volume low pressure (HVLP) air atomization paint spray gun.

BACKGROUND ART

One class of spray gun uses pressurized air for atomizing liquid such as paint and for shaping the envelope or pattern of the atomized liquid as it is discharged from a nozzle assembly on the gun. Air atomization spray guns broadly fall into two classes. One type of air atomization spray gun uses a low volume flow of high pressure air for atomization and pattern shaping. The air pressure typically may be on the order of from 40 psi (2.81 Kg/cm$^2$) to as high as 100 psi (7.03 Kg/cm$^2$), or more. This type of spray gun is capable of producing very fine uniform droplets of paint. However, the high pressure air discharged from the nozzle assembly imparts a relatively high velocity to the paint droplets. As a consequence of the high velocity, some of the droplets will be deflected from the surface being coated, producing a less than optimal transfer efficiency. Paint droplets that are not deposited on the surface being coated end up in the surrounding environment and consequently can present an environmental problem.

A second type of air atomization paint spray gun uses a relatively high volume flow of low pressure air for atomization and pattern shaping. The lower air pressure imparts a lower velocity to the atomized paint. However, the lower air pressure has resulted in larger paint droplets than produced with high air pressure and has presented problems in achieving uniformity in droplet size and optimal pattern shape for high production applications. The larger lower velocity droplets are less prone to be deflected from the surface being coated. Consequently, the transfer efficiency is increased and less paint is dispersed into the environment.

The pressure of the atomization and pattern shaping air used for HVLP spay guns is generally less than about 15 psi (1.05 Kg/cm$^2$) and in some jurisdictions is kept to less than 10 psi (0.703 Kg/cm$^2$). Some jurisdictions, for example, provide more lax air pollution control regulations if the air discharge pressure at the nozzle is no greater than 10 psi (0.703 Kg/cm$^2$). The low air pressure may be produced either through the use of a high volume low pressure air turbine or by using a conventional high pressure compressed air source and suitable means for lowering the air pressure and increasing the volume flow, such as calibrated pressure dropping orifices or a pressure regulator.

An HVLP paint spray gun uses a nozzle assembly for fluid atomization and for shaping the pattern of the atomized fluid. The nozzle assembly includes a fluid tip and an air cap and also may include a baffle which distributes air flow. The fluid tip has a central fluid chamber leading to a fluid discharge orifice. A valve needle controls the discharge of fluid from the orifice. The air cap surrounds the fluid tip. An annular atomization air discharge orifice is formed between the fluid tip and the air cap. The air cap also typically includes two projecting horns on diametrically opposite sides of the fluid orifice for directing pattern shaping air at the atomized fluid to flatten the atomized fluid envelope. Prior art HVLP paint spray guns typically have a cylindrical projection on the fluid tip which extends at least flush with the front of the air discharge orifice in the air cap. The fluid discharge orifice is located at the front of the cylindrical projection. The cylindrical projection has been found to limit energy transfer to the fluid as it is emitted from the orifice and therefore to reduce the atomization efficiency. Another early fluid tip design had a conical exterior surface which projected through the air cap atomization air orifice. Previous HVLP nozzle assembly designs have not aggressively controlled air and fluid flow for maximum efficiency while maintaining high atomization performance. Consequently, prior art HVLP paint spray guns have had some deficiency in performance. The quality of atomization, particle size and pattern shape have not been as good as with high pressure atomization spray guns under certain spraying conditions. HVLP spray guns also have had difficulty in atomizing certain paints and in operating in high productivity situations while producing the highest quality finish coating.

DISCLOSURE OF INVENTION

The invention is directed to an improved nozzle assembly for an HVLP paint spray gun for providing superior spray painting performance. The nozzle assembly has a fluid tip and an air cap and preferably also includes a baffle for uniformly distributing atomization and pattern shaping air flow in the nozzle assembly. The fluid tip has a central fluid passage which terminates at a fluid discharge orifice. A valve needle extends into the passage for controlling the discharge of fluid. A forward external surface on the fluid tip is conical. The fluid discharge orifice is located at or adjacent the vertex of the conical surface. The conical surface has art included vertex angle in the range of from 60° to 90°.

The air cap fits over the fluid tip and has a central opening which surrounds the front of the fluid tip to form an annular atomization air discharge orifice. Preferably, the fluid discharge orifice on the fluid tip lies substantially in the plane of the front face of the air cap opening for optimal interaction of the fluid and the air. The air cap has an interior surface which is spaced from the conical surface on the fluid tip to form a conical chamber which converges towards the air discharge orifice. Adjacent the opening, the interior air cap surface is in the shape of a frustum of a right circular cone. The cone has an included vertex angle lying within the range of from 10020 to 150°. Atomization air passes through a plurality of holes in a radial flange on the fluid tip to the chamber between the air cap and the fluid tip. The holes are circumferentially spaces around the axis of the fluid tip. Preferably, at least 12 calibrated holes are formed through the flange to uniformly distribute the air to the chamber to produce optimum atomization uniformity. The baffle further aids atomization uniformity by controlling distribution of the air to the fluid tip holes.

By eliminating the cylindrical extension commonly found on the fluid tip used in prior art HVLP nozzle assemblies and by optimizing the design configuration of the atomization air chamber and discharge orifice in the nozzle assembly, the kinetic energy transferred between the air and the fluid is optimized. This results in the formation of smaller and more uniform droplets and also permits greater pattern control to provide an HVLP paint gun suitable for high production applications and for applying more difficult coating materials.

Accordingly, it is an object of the invention to provide an improved nozzle assembly for use in HVLP paint spray guns.

Other objects and advantages of the invention will become apparent from the following detailed description of the invention and the accompanying drawings.

BEST MODE FOR CARRYING OUT THE INVENTION

Figure 1:
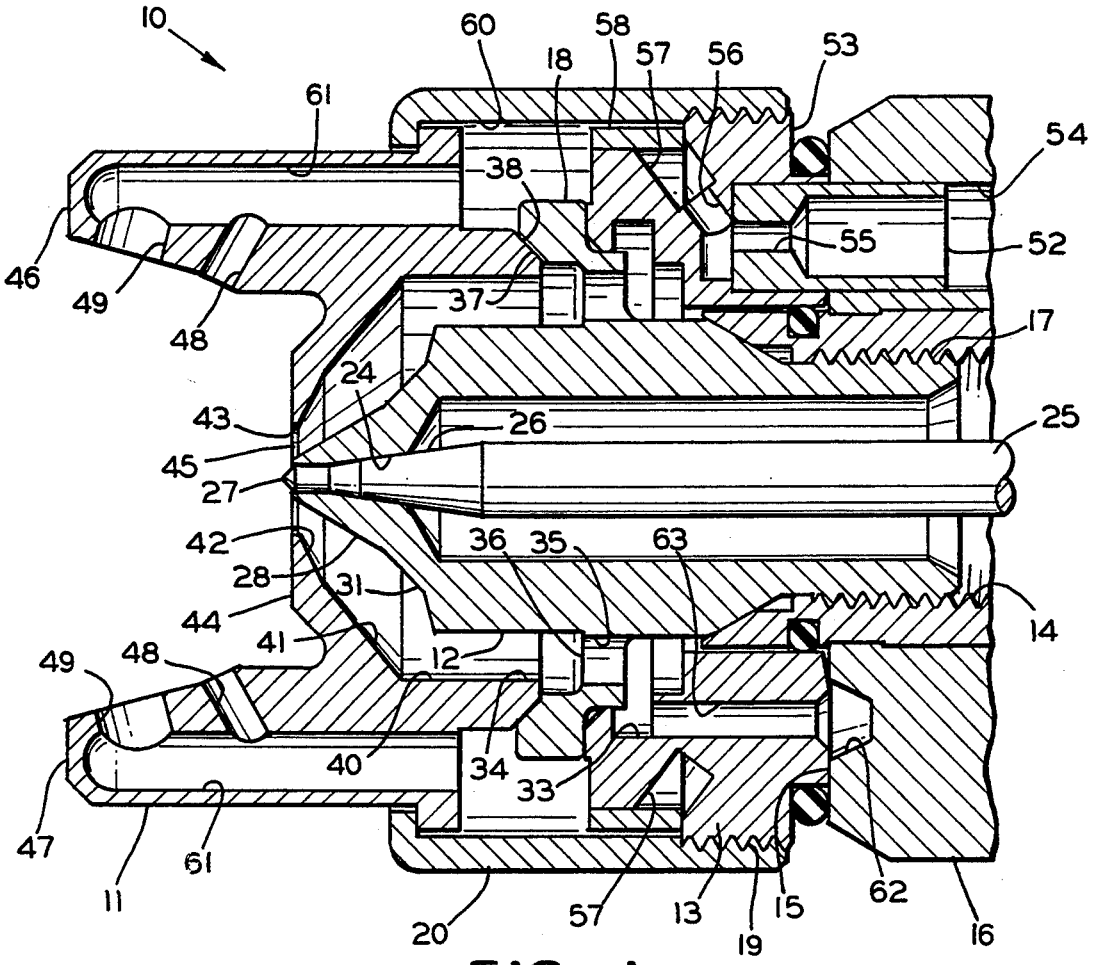
FIG. 1 is a fragmentary cross sectional view through a nozzle assembly according to the invention for an HVLP paint spray gun.

Referring to FIG. 1 of the drawings, a nozzle assembly 10 for an HVLP paint spray gun is shown according to the invention. The nozzle assembly 10 generally includes an air cap 11, a fluid tip 12, and an air distribution baffle 13. The nozzle assembly 10 is shown secured to an internally threaded tube 14 which extends from a front end 15 of a spray gun body 16. The nozzle assembly 10 is secured to the spray gun body 16 by positioning the baffle 13 over the tube 14 in alignment with the front end 15 of the gun body 16 and screwing an externally threaded end 17 on the fluid tip 12 into the tube 14. A radial flange 18 on the fluid tip 12 clamps the baffle to the gun body end 15. The baffle 13 has a threaded perimeter 19. The air cap 11 is aligned and secured to the fluid 12 by a retainer ring 20 which is threaded onto the baffle perimeter 19.

Figure 2:
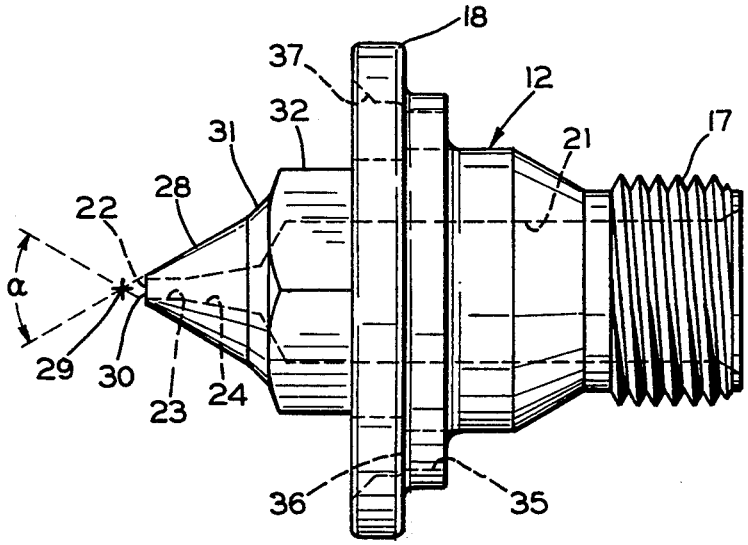
FIG. 2 is a side elevational view of a fluid tip for the nozzle assembly of FIG. 1.
Figure 3:
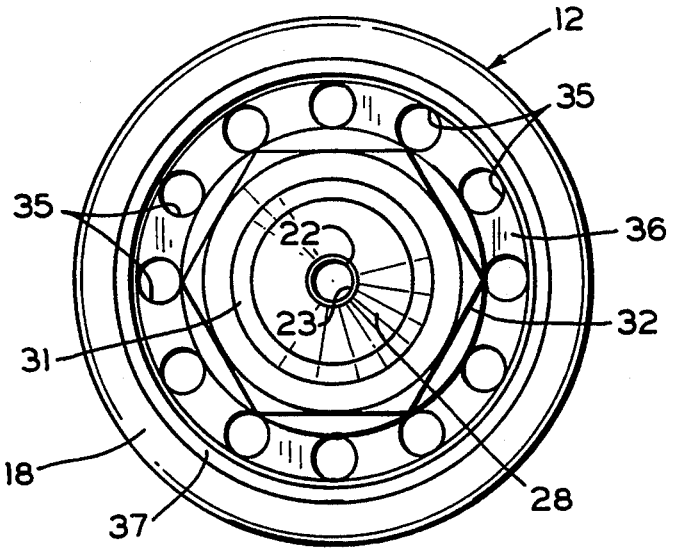
FIG. 3 is a front elevational view of the fluid tip of FIG. 2.

Details of the fluid tip 12 are shown in FIGS. 1–3. The fluid tip 12 has an axial opening 21 which terminates at a paint discharge orifice 22. The opening 21 has a short straight section 23 and a conic tapered section 24 adjacent the orifice 22. As shown in FIG. 1, a valve needle 25 extends through the opening 21. The valve needle 25 has a tip 27 with an adjacent tapered section 26 which normally seats against the conic section 24 of the fluid tip 12 to block the discharge of paint from the orifice 22. When the spray gun is triggered, the valve needle 25 is withdrawn in an axial direction into the opening 21 away from the conic section 24 to allow paint to flow through the opening 21 and to be discharged from the orifice 22.

The fluid tip 12 has an exterior surface 28 adjacent the orifice 22 which has the shape of a right circular cone having a vertex 29 aligned with and adjacent the orifice 22. A front end 30 on the fluid tip 12 may be a sharp annular edge or may be a small flat annular surface to reduce the risk of damage to the fluid tip 12. Preferably, the annulus at the front end 30 is as narrow as possible and is no greater in thickness than 0.015 inch (0.381 mm) to encourage the atomization air flowing along the exterior surface 28 to act immediately on the discharged fluid to enhance breakup of the fluid stream into particles. The sides of the conic surface 28 form an included angle ct relative to the vertex 29 which is in the range of from 60° to 90°. An optional second conic surface 31 may be formed behind the conic surface 28. The surface 31 has a greater included vertex angle than the section 28. For optimum performance, the conic surface 28 has an included vertex angle ct of 60° and the conic surface 31 has an included vertex angle of 90°. A hexagonal section 32 is formed behind the section 31 to receive a wrench (not shown) to facilitate attaching the fluid tip 12 to and removing the fluid tip 12 from the spray gun body 16.

The flange 18 on the fluid tip separates two annular chambers 33 and 34 through which atomization air flows. As will be discussed below, the baffle 13 delivers atomization air to the rear chamber 33 which is formed between the baffle 13 and the fluid tip 12. The air flows from the rear chamber 33 through a plurality of orifices or holes 35 in a web 36 on the flange 18 to the chamber 34 which is formed between the fluid tip 12 and the air cap 11. Preferably, the web 36 contains at least 12 holes 36 which are uniformly spaced around the web 36 on a circumference which is coaxial with the axis of the fluid tip 12, as shown in FIG. 3. The holes 35 function to uniformly distribute atomization air around the chamber 34 to optimize fluid atomization uniformity. Radially outwardly from the web 36, the flange 18 has a conical surface 37. A spherical surface 38 on the air cap 11 seats on the fluid tip surface 37. By making the fluid tip surface 37 conical and the air cap surface 38 spherical, the air cap will align with and seat against the fluid tip 12.

Figure 4:
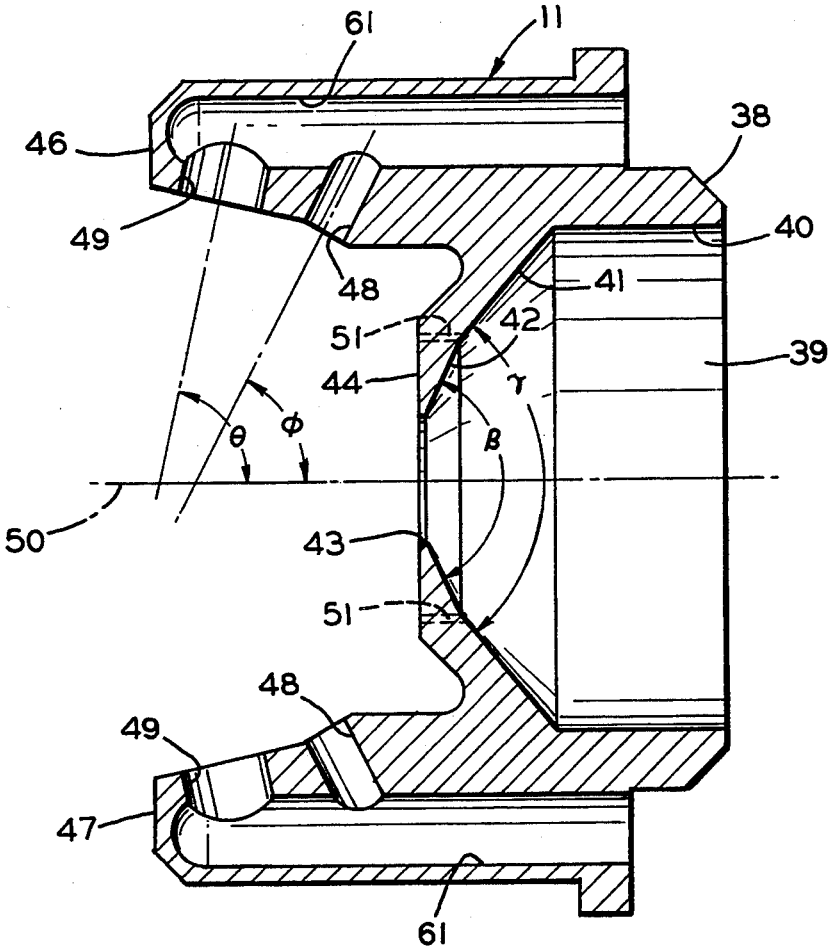
FIG. 4 is a cross sectional view through an air cap for the nozzle assembly of FIG. 1.

Referring now to FIGS. 1 and 4, details are shown for the air cap 11. The air cap 11 has an axial passage 39 which has a rear cylindrical portion 40, a first conic surface 41, a second conic surface 42 and a front opening 43 which extends flush with a front face 44. When the air cap 11 and the fluid tip 12 are secured together, the front end 30 of the fluid tip 12 is located in substantially the plane of the front face 44 of the air cap 11. Specifically, the front face 30 should be within ±0.010 inch (±0.254 mm) of the plane of the front face 44. The front end 30 and the opening 43 define an annular atomization air discharge orifice 45 which is coaxial with and surrounds the fluid discharge orifice 22.

The interior walls of the axial passage 39 in the air cap 11 cooperate with the exterior walls of the fluid tip 12 to form the chamber 34. The first and second conic air cap surfaces 41 and 42 cooperate with the conic surfaces 31 and 28 on the fluid tip 12 to form a conical air annulus which converges to the annular air discharge orifice 45 to maximize the energy of the low velocity, high volume air. The conic surfaces 41 and 42 are in the form of frustums of right circular cones which have included vertex angles within the range of from 100° to 150°. Preferably, the conic surface 41 has an included vertex angle $\gamma$ of about 100° and the conic surface 42 has an included vertex angle $\beta$ in the range of from 124° to 128°. It will be appreciated that although two conic surfaces 41 and 42 are shown and preferred, the air cap 11 may be provided with a single conic surface 42 having a vertex angle within the preferred range. By providing two surfaces 41 and 42 of different angles, the walls of the air cap 11 may be made thinner and additional control is possible over the air flow through the chamber 34. The preferred angles for the conic surfaces 41 and 42 help accelerate and compress the flowing air to maximize its kinetic energy prior to interaction with the fluid.

For optimum efficiency, the air cap 11 has a very thin wall at the opening 43, preferably no greater than 0.015 inch (0.381 mm). As previously indicated, the fluid tip 12 should also have a thin wall surrounding the fluid discharge orifice 22. The thin walls at the exit of the fluid orifice 22 and at the air cap opening 43 optimize energy transfer between the atomization air and the fluid. These features provide a clean break for the air stream from the interior air cap wall 42 and encourage immediate action on the fluid stream to completely break apart the particles.

Two air horns 46 and 47 extend from diametrically opposite sides of the air cap 11. Two orifices 48 and 49 for discharging pattern shaping air are formed on each air horn 46 and 47. The orifices 48 and 49 direct a high volume flow of low velocity air at the envelope of atomized fluid for shaping the envelope from a round expanding conical shape into a flat fan shape. The expanding atomized paint envelope first encounters air from the opposing orifices 48 and subsequently encounters air from the opposing orifices 49. The orifices 49 may be larger than the orifices 48 to discharge a greater air flow volume because the orifices 49 are further from the atomized paint envelope and the envelope is larger when it encounters air from the orifices 49 than when it encounters air from the orifices 48. Preferably, the orifices 48 are angled at an angle $\phi$ of about 62° to an axis 50 of the air cap 11 and the orifices 49 are angled at an angle $\phi$ of about 77° to the axis 50. It will be appreciated that the angle $\phi$ may be greater than the angle $\phi$ because the atomized fluid envelope has been partially flattened before it encounters air from the orifices 49. The angles of the dual pairs of jets form the air horns 46 and 47, which are steeper than found in the prior art, provide a long evenly distributed pattern which is desirable for high production applications. As is known in the art, the shape of the pattern may be varied between a flatten shape and a round shape by adjusting the flow of pattern shaping air.

Preferably, the air cap 11 has four passages 51 which extend from the chamber 34 to the front face 44. The passages are located between the air horns 46 and 47 and are spaced to direct jets of air on either side of the jets emitted from the orifices 48. The air jets emitted from the passages 51 serve dual purposes, namely, to reduce the risk of paint depositing on the air cap face 44 and to help transport the spray forward to the target.

Figure 5:
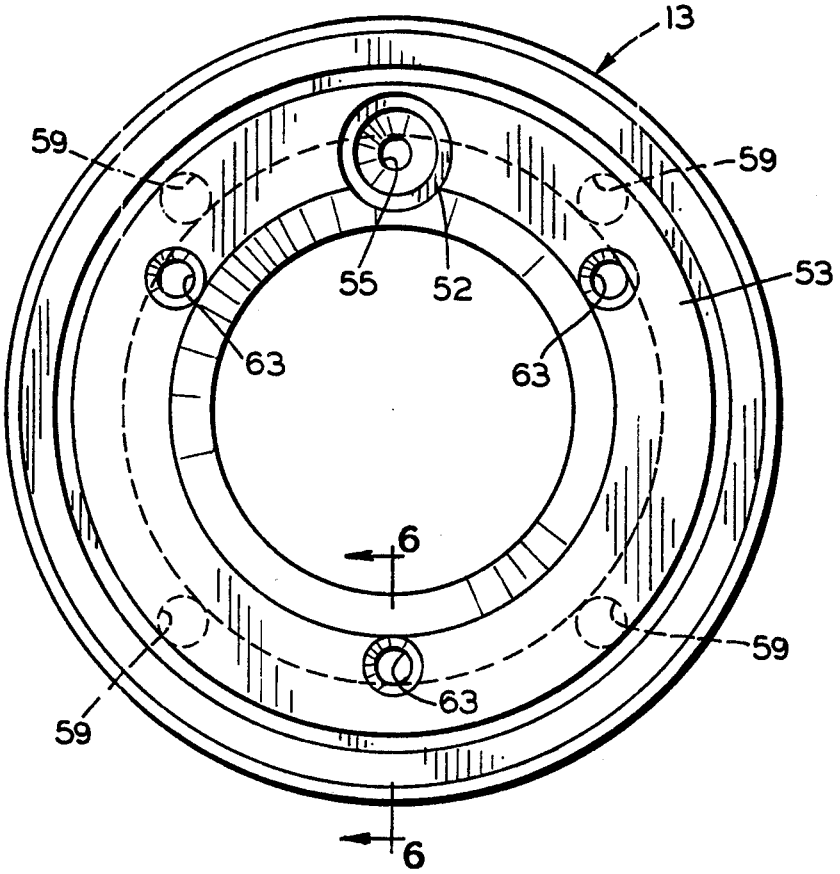
FIG. 5 is a is a rear elevational view of a baffle for the nozzle assembly of FIG. 1.
Figure 6:
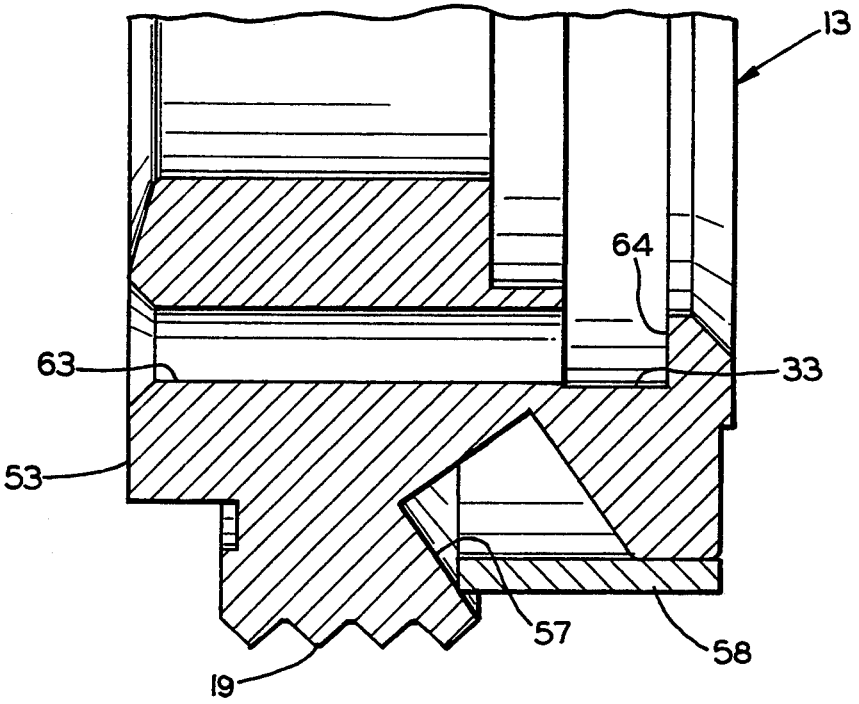
FIG. 6 is an enlarged cross sectional view as taken along line 6—6 of FIG. 5.

Details of the baffle 13 are shown in FIGS. 1, 5 and 6. The baffle 13 has a robe 52 which projects from a rear face 53 into an air passage 54 in the spray gun body 16 for receiving pattern shaping air. If the spray gun is designed to operate from high pressure air, the air in the passage 54 may be at a high pressure and the robe 52 may have a calibrated orifice 55 for dropping the air pressure to the desired low pressure. As the air pressure is dropped, its volume will increase. The low pressure pattern shaping air from the robe 52 flows through a passage 56 into an annular groove 57 which extends around the perimeter of the baffle 13. A sleeve 58 is secured to the perimeter of the baffle 13 for closing a groove 57. The closed groove 57 distributes the pattern shaping air around the baffle. Four passages 59 connect the groove 57 to an annular chamber 60 formed between the baffle 13, the fluid tip 12, the air cap 11 and the retainer ting 20. Preferably, the passages 59 are aligned 45° from the vertical and are uniformly spaces apart so that they will not align directly with passages 61 in the air horns 46 and 47 during normal operation of the spray gun. This arrangement increases the uniformity in the pattern shaping air pressure delivered to both of the air horns 46 and 47.

High pressure air in the spray gun body 16 also is delivered to an annular groove 62 which extends around the front end 15 of the body 16. The baffle 13 has three circumferentially spaced calibrated orifices or passages 63 which receive air from the groove 62, drop the air pressure to a desired low atomization air pressure and deliver the air to the chamber 33. The passages 63 are directed at an annular flange 64 on the baffle 13 which deflects the air flow to more uniformly distribute air around the chamber 33. From the chamber 33, the atomization air flows though the fluid tip orifices 35 to the chamber 34 and thence to the annular orifice 45.

The above described nozzle assembly 10 for an HVLP spray gun incorporates a number of design features which produces a higher fluid flow, a more uniform particle size and a more uniform spray pattern than was possible with prior art HVLP spry guns. The conical fluid tip surface 28 optimizes the air to fluid impingement angle and thus increases relative velocity between the atomization air and the fluid. The angle of the interior conical air cap surfaces 42 and 41 accelerate and compress the atomization air, thus maximizing its kinetic energy prior to interaction with the fluid. The combination of the angles of the fluid tip surface 28 and the air cap surfaces 42 and 41 form a converging conical air annulus unique to this design and important to maximizing the energy of the low velocity, high volume air flow. The kinetic energy transfer between the atomization air and the fluid is further optimized by maintaining thin walls at the exit of the fluid orifice 22 and of the air cap opening 43. The exit of the fluid tip orifice 22 is maintained substantially flush to the air cap face 44 as a further method to assure optimal interaction of the fluid and the atomization air. The thin walls provide a clean break for the air stream from the interior air cap call 42 and encourage immediate action on the fluid stream to completely break apart the particles. Further, the air flow control passages 63 in the baffle 13 in combination with providing at least 12 openings 35 in the fluid tip 12 provide an evenly distributed sheet of atomization air around the orifice 45. This improves the consistency of the pattern shape and reduces the atomization particle size variance. Finally, the steep angles of the dual horn air jet orifices 48 and 49 shape a long evenly distributed pattern desirable for high production applications.

It will be appreciated that various modifications and changes may be made to the above described preferred embodiment of a nozzle assembly for an HVLP spray gun without departing from the spirit and the scope of the following claims.

We claim:

1. A nozzle assembly for an HVLP spray gun including a fluid tip and an air cap, said fluid tip having an axial passage terminating at a fluid discharge orifice and having an exterior surface adjacent said fluid discharge orifice, said air cap having an opening cooperating with said exterior fluid tip surface for defining an annular atomization air discharge orifice surrounding said fluid discharge orifice, said air cap having a conic interior surface surrounding said opening, said nozzle assembly being characterized by said exterior fluid tip surface being conical, wherein said orifice is disposed at substantially the vertex of said conical surface and said vertex has an included angle of between 60° and 90°, and wherein said interior air cap surface adjacent said opening is a frustum of a right circular cone having a vertex angle of between 100° and 150°.

2. A nozzle assembly for an HVLP spray gun, as set forth in claim 1, and wherein said air cap opening has a front face lying in a plane and wherein said fluid tip discharge orifice lies substantially in said plane.

3. A nozzle assembly for an HVLP spray gun, as set forth in claim 2, and wherein said fluid tip discharge orifice lies within ±0.010 inch of the plane of said air cap face.

4. A nozzle assembly for an HVLP spray gun, as set forth in claim 3, and wherein said fluid tip vertex has an angle of substantially 60°.

5. A nozzle assembly for an HVLP spray gun, as set froth in claim 4, and wherein said interior air cap surface has a vertex angle of between about 132° and 136°.

6. A nozzle assembly for an HVLP spray gun, as set forth in claim 1, and wherein said air cap has a wall thickness of no greater than 0.015 inch at said opening.

7. A nozzle assembly for an HVLP spray gun, as set forth in claim 1, and wherein said fluid tip has an annular face surrounding said fluid discharge orifice having a thickness no greater than 0.015 in.

8. A nozzle assembly for an HVLP spray gun, as set forth in claim 1, and wherein said fluid tip and said air cap define an atomization air chamber including said exterior fluid tip surface and said interior air cap surface, and wherein said fluid tip includes a radial flange having at least 12 orifices uniformly spaced around a circumference and communicating with said atomization air chamber, said at least 12 orifices uniformly distributing atomization air to said atomization air chamber.

9. A nozzle assembly for an HVLP spray gun, as set forth in claim 8 and further including a baffle for distributing low pressure air to said fluid tip openings and to said air cap.

10. A nozzle assembly for an HVLP spray gun, as set forth in claim 1, and wherein said air cap has two air horns located on diametrically opposite sides of said opening, and wherein each of said air horns has a first pattern shaping air orifice directed at an angle of substantially 62° to an axis of said air cap opening.

11. A nozzle assembly for an HVLP spray gun including a fluid tip and an air cap having a front face lying in a plane, said fluid tip having an axial passage terminating at a fluid discharge orifice and having an exterior surface adjacent said fluid discharge orifice, said air cap having an opening cooperating with said exterior fluid tip surface for defining an annular atomization air discharge orifice surrounding said fluid discharge orifice, said air cap having a conic interior surface surrounding said opening, said nozzle assembly being characterized by said fluid tip discharge orifice lying within ±0.010 inch of the plane of said air cap face, said exterior fluid tip surface being conical, wherein said orifice is disposed at substantially the vertex of said conical surface and said vertex has an included angle of substantially 60°, and wherein said interior air cap surface adjacent said opening is a frustum of a right circular cone having a vertex angle of between about 132° and 136° and wherein said air cap has adjacent said interior surface and spaced from said air cap opening a second interior surface in the form of a frustum of a right circular cone having a vertex angle of about 100°.

12. A nozzle assembly for an HVLP spray gun, as set forth in claim 11, and wherein said air cap has a wall thickness of no greater than 0.015 inch at said opening.

13. A nozzle assembly for an HVLP spray gun including a fluid tip and an air cap, said fluid tip having an axial passage terminating at a fluid discharge orifice and having an exterior surface adjacent said fluid discharge orifice, said air cap having an opening cooperating with said exterior fluid tip surface for defining an annular atomization air discharge orifice surrounding said fluid discharge orifice, said air cap having a conic interior surface surrounding said opening, said nozzle assembly being characterized by said exterior fluid tip surface being conical, wherein said orifice is disposed at substantially the vertex of said conical surface and said vertex has an included angle of between 60° and 90°, and wherein said interior air cap surface adjacent said opening is a frustum of a right circular cone having a vertex angle of between 100° and 150° and wherein said air cap has an annular face between said fluid discharge orifice and said exterior surface having a thickness of no greater than 0.015 inch.

14. A nozzle assembly for an HVLP spray gun including a fluid tip and an air cap, said fluid tip having an axial passage terminating at a fluid discharge orifice and having an exterior surface adjacent said fluid discharge orifice, said air cap having an opening cooperating with said exterior fluid tip surface for defining an annular atomization air discharge orifice surrounding said fluid discharge orifice, said air cap having a conic interior surface surrounding said opening, said nozzle assembly being characterized by said exterior fluid tip surface being conical, wherein said orifice is disposed at substantially the vertex of said conical surface and said vertex has an included angle of between 60° and 90°, and wherein said interior air cap surface adjacent said opening is a frustum of a right circular cone having a vertex angle of between 100° and 150°, said air cap having two air horns located on diametrically opposite sides of said opening, each of said air horns having a first pattern shaping air orifice directed at an angle of substantially 62° to an axis of said air cap opening, and wherein each of said air horns has a second pattern shaping air orifice directed at an angle of substantially 77° to the axis of said air cap opening, and wherein said second pattern shaping air orifices are spaced further from said air cap opening than said first pattern shaping air orifices.

* * * * *